US005303891A

United States Patent [19]

Powers

[11] Patent Number: 5,303,891

[45] Date of Patent: Apr. 19, 1994

[54] BRACKET FOR SUPPORTING A LENGTH OF LUMBER AND PROCESS FOR USING THE SAME

[76] Inventor: Bill Powers, 1676 Sunsetridge, Laguna Beach, Calif. 92651

[21] Appl. No.: 770,909

[22] Filed: Oct. 4, 1991

[51] Int. Cl.[5] ..... A47B 96/00; E04G 3/00

[52] U.S. Cl. ..... 248/218.4; 248/410; 248/246; 182/186

[58] Field of Search ..... 182/151, 223, 185, 186, 182/225, 226, 154; 248/218.4, 300, 246, 125, 164, 410; 403/85, 346, 400, 116, 396

[56] References Cited

U.S. PATENT DOCUMENTS

| | | | |
|---|---|---|---|
| 789,843 | 5/1905 | Dennis | 248/246 |
| 1,890,386 | 12/1932 | Kingston | 403/400 X |
| 2,845,317 | 7/1958 | Orman | 248/164 |
| 2,993,254 | 7/1961 | Larson | 403/396 X |
| 3,269,682 | 8/1966 | Alpine | 248/225.31 |
| 4,008,786 | 2/1977 | Canavan | 182/186 |
| 4,133,412 | 1/1979 | Hildebrandt | 248/164 X |

FOREIGN PATENT DOCUMENTS

| | | | |
|---|---|---|---|
| 2100115 | 12/1982 | United Kingdom | 248/218.4 |

*Primary Examiner*—Karen J. Chotkowski
*Attorney, Agent, or Firm*—Edgar W. Averill, Jr.

[57] ABSTRACT

A bracket for supporting a length of lumber adjacent a vertical member such as a stud. The bracket has a central bar to which a pair of end bars are welded. The end bars extend in both directions away from the central bar. The central bar is then placed adjacent the face of a vertical stud and the end bars are sufficiently separated so that the bracket may be rotated a small amount. The bracket is then rotated and a length of lumber is then inserted between the upper and lower bars in a cantilevered member and held securely so that it may be worked on, such as cut to length, along the cantilevered ends. The process of using the bracket is also disclosed and a bracket having four end bars is also disclosed.

1 Claim, 3 Drawing Sheets

BRACKET FOR SUPPORTING A LENGTH OF LUMBER AND PROCESS FOR USING THE SAME

BACKGROUND OF THE INVENTION

The field of the invention is carpentry tools and the invention relates more particularly to devices for holding such as a length of lumber.

The most common device used to support a length of lumber to permit the length of lumber to be sawn or planed or otherwise worked on is a pair of sawhorses. For instance, in the construction of a single family residence, a pair of sawhorses is commonly used to cut lengths of lumber to provide firebreaks and other wooden structures. Unfortunately, the sawhorses can get in the way and tend to take up a lot of room when not in use. While brackets have been provided to assist in assembling a sawhorse, they do not replace the sawhorse. One such bracket is shown in U.S. Pat. No. 4,133,412. Brackets have also been used to hold forms such as in U.S. Pat. No. 1,787,799 and work support brackets have been used such as those shown in U.S. Pat. No. 4,039,064. None of these eliminate the necessity for a sawhorse.

SUMMARY OF THE INVENTION

It is an object of the present invention to provide a bracket which can be held by a stud or other vertical member and which is capable of holding a length of lumber or other elongated object in a cantilevered manner.

The present invention is for a bracket for supporting a length of lumber adjacent a vertical member. The bracket has first and second bars welded or otherwise affixed to a central bar. The bars are separated slightly more than the width of the vertical stud, and the bars extend both ways from the central bar. Thus, when the central bar is placed adjacent a vertical stud and rotated, the end bars contact both edges of the stud leaving a space through which a length of lumber may be inserted and supported in a cantilevered member. The length of lumber may then be worked on as if it were overhanging a pair of sawhorses and yet no sawhorses are in the way. The process of using the bracket of the present invention involves placing the central bar of the bracket against a vertical member and rotating it until both of its end bars contact the sides of the stud. Then, a length of lumber is inserted between the end bars and lowered until it is supported by the end bars in a cantilevered manner. The bracket may also be constructed with two end plates, one of which is movable, and four bars which permit the bracket to hold a length of lumber cantilevered in either direction.

DESCRIPTION OF THE PREFERRED EMBODIMENT

Figure 1:
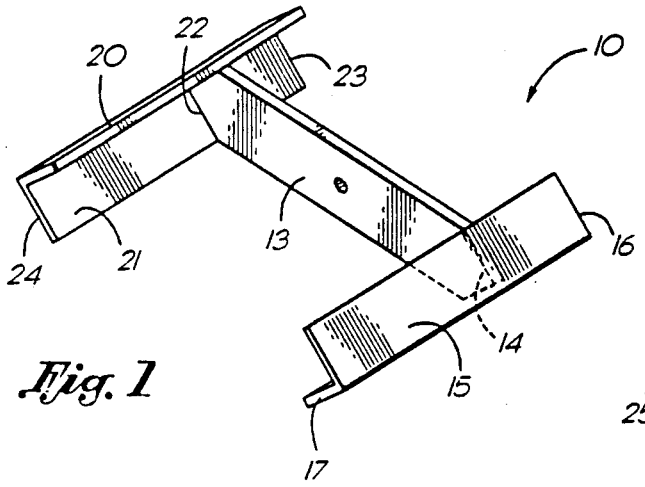
FIG. 1 is a perspective view of the bracket for supporting a length of lumber of the present invention.
Figure 2:
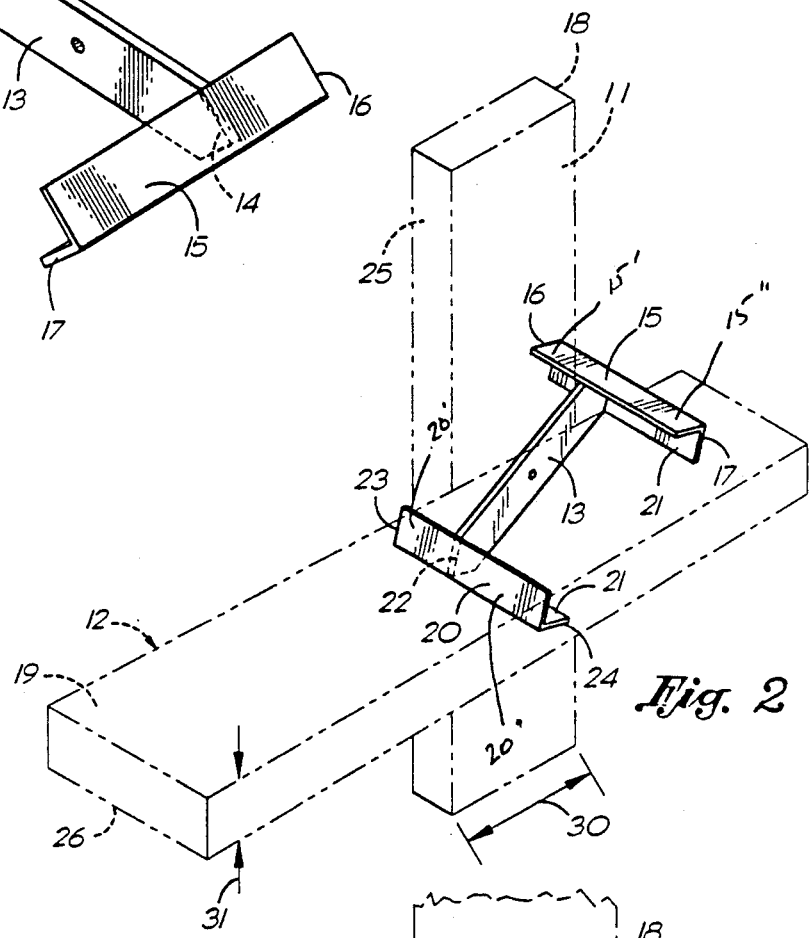
FIG. 2 is a perspective view of the bracket of FIG. showing a vertical member or stud in phantom view and showing a length of lumber supported by the bracket, also in phantom view.
Figure 3:
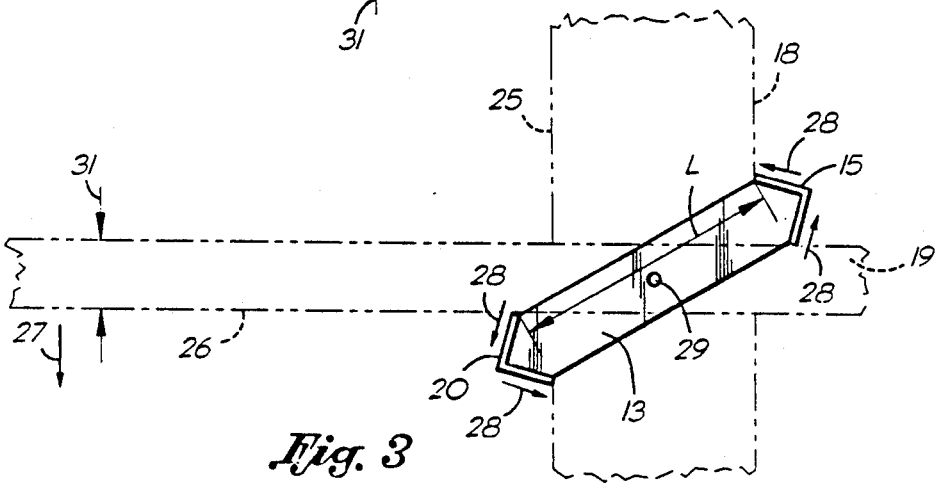
FIG. 3 is a side view of the assembly of FIG. 2.

The bracket of the present invention is shown in perspective view in FIG. 1 and indicated by reference character 10. Bracket 10 is shown in perspective view in FIG. 2 together with a vertical member or stud 11 shown in phantom view and a length of lumber 12, also shown in phantom view. A central bar 13 is welded at its first end 14 to a first length of angle iron 15 which has a first end 16 and a second end 17. As shown in FIGS. 2 and 3, first length 15 contacts the vertical side 18 of stud 11 and also contacts the upper surface 19 of length of lumber 12. A second length of angle iron 20 has an inner surface 21 to which the second end 22 of central bar 13 is welded or otherwise affixed. Second length of angle iron 20 has a first end 23 and a second end 24.

As also shown in 23, second length of angle iron 20 contacts vertical side 25 of stud 11 and also contacts the lower surface 26 of length of lumber 12. Length of lumber 12 is cantilevered as indicated by arrow 27 so that it tends to try to rotate the bracket as shown by arrows 28. This causes the bracket to bind against the stud 11 and holds the bracket against stud 11, even if the central bar 13 is not affixed to the stud. To facilitate the holding of the bracket when it is not being turned by a cantilevered length of lumber, a nail hole 29 is provided to facilitate the attachment of central bar 13 to stud 11. It should be noted that the bracket should be turned into place as shown in FIG. 3 before the nail is inserted since it must be positioned so that both lengths of angle iron contact the edges of the stud. It should also be noted that the bracket can be rotated clockwise and used to hold a length of lumber which is cantilevered in the opposite direction. The bracket must of course have a length "L" larger than the width 30 of stud 11. Preferably this length is sufficient so that the thickness 31 of the length of lumber 12 will cause the length of lumber to be supported in a horizontal manner. Since the widths of building studs and lumber is almost always the same, this length can be easily provided.

Figure 4:
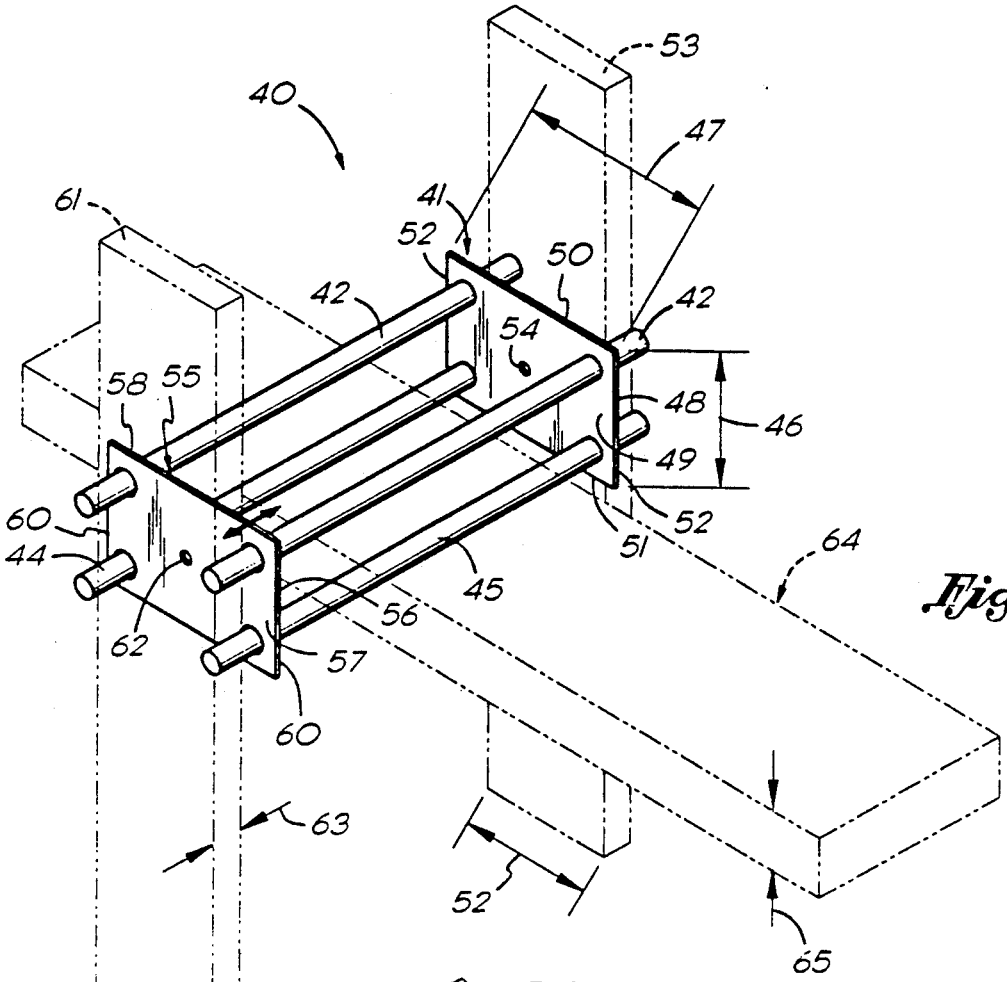
FIG. 4 is a perspective view of an alternate embodiment of bracket of the present invention.
Figure 5:
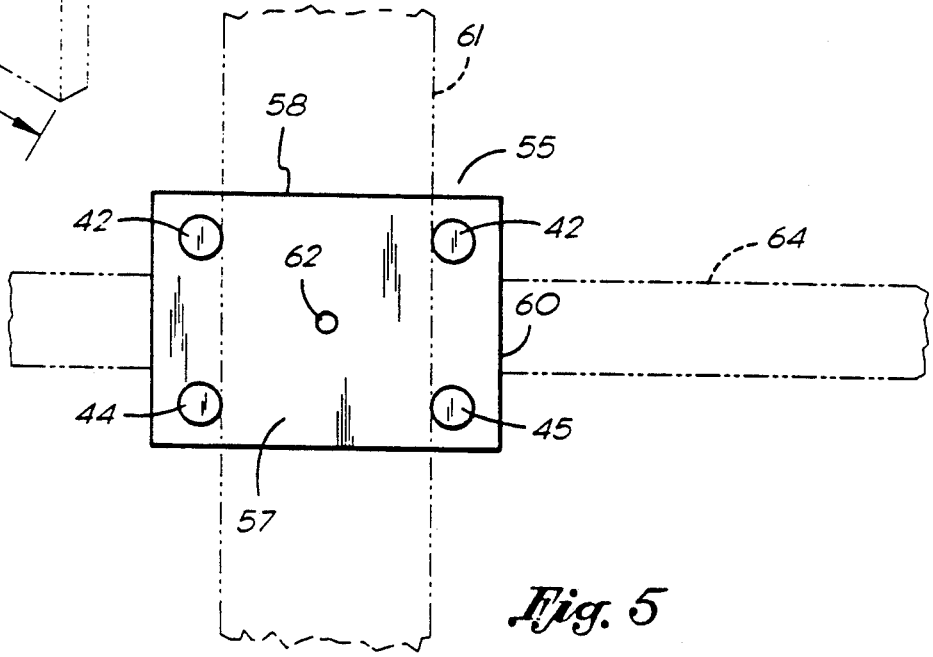
FIG. 5 is a side view of the bracket of FIG. 4.

A different construction of bracket is shown in FIGS. 4 and 5 where a bracket 40 has a first end plate 41 to which a pair of upper bars, 42, are welded or otherwise affixed as are a pair of lower bars 44 and 45. First plate 41 has a height 46, a width 47, an inner face 48 and an outer face 49, a top edge 50 and a bottom edge 51, and sides 52. The bars 42, 44 and 45 are spaced so that they closely straddle the stud width 52 of stud 53. A nail hole 54 is provided so that first plate 41 can be easily affixed to stud 53.

A second endplate 55 is slidably held over bars 42, 44 and 45. Second endplate 55 has an outer face 56, an inner face 57, a top edge 58, a bottom edge 59 and two sides 60. In use, the first plate is nailed or otherwise affixed to stud 53 and second plate 55 is positioned between stud 53 and stud 61. Next, the second plate 55 is slid so that it contacts stud 61 and is then nailed in place through nail hole 62. The bars extend sufficiently past the endplates so that they pass over the stud thickness 63.

In use, a length of lumber 64 having a thickness 65 is placed between upper bars 42 and lower bars 44 and 45 as indicated best in FIG. 5. It can be cantilevered in either direction since in one direction bars 42 and 45 will bind against the stud edges and, in the other direction, bars 42 and 44 will bind against the edges of the vertical studs.

Figure 6:
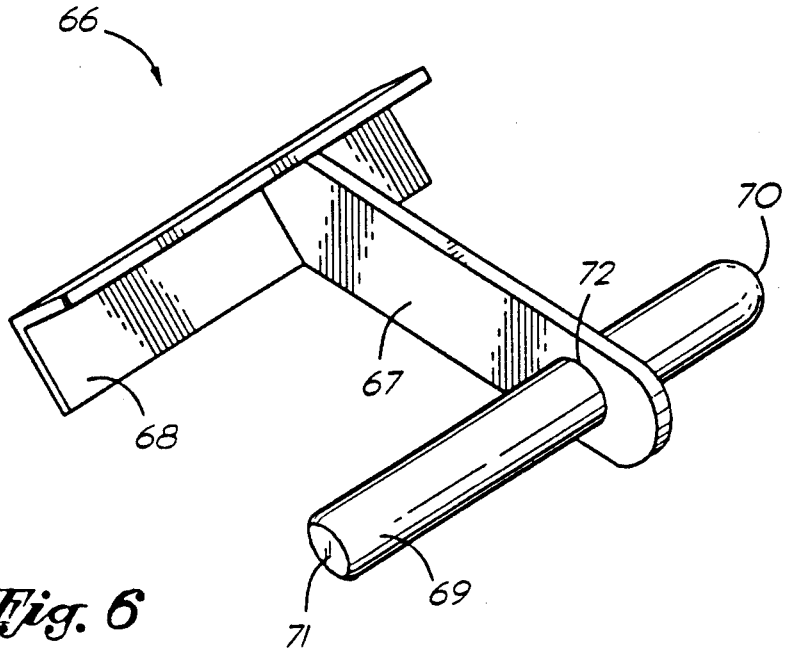
FIG. 6 is a perspective view of a alternate embodiment of the bracket of FIG. 1.

An alternate embodiment of the bracket of FIG. 1 is shown in perspective view in FIG. 6 and indicated by reference character 66. Bracket 66 has a central bar 67 to which a length of angle iron 68 is welded on one end. Near the other end, a rod 69 having a rounded, short end 70 and a long end 71 is welded at circular opening 72 in central bar 67.

Figure 7:
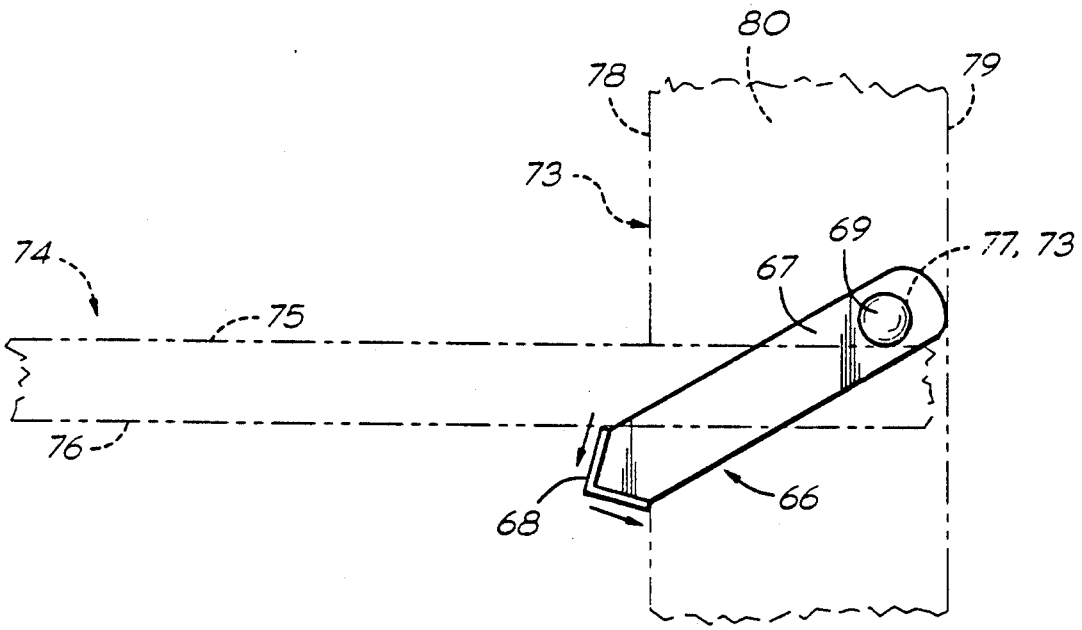
FIG. 7 is a side view of the bracket of FIG. 6 showing a vertical stud and a horizontal plank of lumber in phantom view.

This version, shown in 66, is useful for attaching to a stud which is abutting a wall and does not permit the bracket to be inserted over both ends of the vertical stud. Thus, in FIG. 7, a vertical stud 73 has an outer available side 78 and a side 79 which is abutting a wall or other object. Thus, a horizontal length of lumber 74, shown in phantom view in FIG. 7, has an upper surface 75 which abuts rod 69 and a lower surface 76 which abuts the length of angle iron 68. The angle iron also abuts the available side 78 of vertical stud 73 in FIG. 7. Rod 69 is held to a hole drilled through vertical stud 73, and the hole is located at reference character 77. Thus, even though the abutting side 79 of vertical stud 73 is not available for contact with an end of the bracket 66, the device is, nonetheless, held by drilling a hole through vertical stud 73 and inserting rod 69 through the hole.

While angle irons and rods are shown as the end members, other shapes of bars may also be used.

The device can be fabricated from a single elongated sheet of metal having two faces, a top, a bottom, a first end and a second end. A slot, or cut, is formed midway at each end which forms an upper tab and a lower tab at each end. The tabs at the first end are bent at opposite directions at right angles to the elongated sheet. The tabs at the second end are also so bent. The resulting device forms a one piece bracket without the necessity of any welding.

The device of the invention is easily placed over a vertical stud. It can be easily removed and continually removed and reinstalled in the most convenient location. Preferably the bracket of the invention is fabricated from iron bars to provide a preferred combination of low cost and strength.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A bracket for supporting parts or material such as a length of lumber adjacent a vertical member, said bracket comprising:

a first length of angle iron having a first or stud side, a second or lumber side, an inwardly facing surface and an outwardly facing surface;

a second length of angle iron also having a first or stud side, a second or lumber side, an inwardly facing surface and an outwardly facing surface; and a central bar having a first end and a second end, said first end being unadjustably affixed at its first end to the inwardly facing surface of the stud and lumber sides of said first length of angle iron and being welded at its second end to the inwardly facing surface of the stud and lumber sides of said second length of angle iron and wherein said central bar has an opening to permit a fastener to pass therethrough.

* * * * *